US005920247A

United States Patent [19]

Pischinger et al.

[11] Patent Number: 5,920,247

[45] Date of Patent: Jul. 6, 1999

[54] ACTUATOR HAVING A MOVABLE TRANSMITTING ELEMENT WITH FRICTIONLESS GUIDANCE

[75] Inventors: Franz Pischinger; Martin Pischinger, both of Aachen, Germany

[73] Assignee: FEV Motorentechnik GmbH & Co. KG, Aachen, Germany

[21] Appl. No.: 09/017,696

[22] Filed: Feb. 3, 1998

[30] Foreign Application Priority Data

Feb. 4, 1997 [DE] Germany ..... 297 01 866

[51] Int. Cl.[6] ..... H01F 7/00

[52] U.S. Cl. ..... 335/229; 251/61.5

[58] Field of Search ..... 335/228, 227, 335/229, 246–8, 256–7, 268–72, 277, 131, 126; 251/61.1, 61.2, 61.3, 61.4, 61.5, 129.01, 129.02, 109, 337

[56] References Cited

U.S. PATENT DOCUMENTS

| | | | |
|---|---|---|---|
| 2,738,450 | 3/1956 | Matthews | 251/129.01 |
| 3,336,942 | 8/1967 | Keith et al. | 251/129.01 |
| 3,563,218 | 2/1971 | Havens | 251/337 |
| 4,203,554 | 5/1980 | Zimmer et al. | 251/141 |
| 5,346,174 | 9/1994 | Harwath | 251/61.3 |

*Primary Examiner*—Lincoln Donovan
*Attorney, Agent, or Firm*—Venable; Gabor J. Kelemen

[57] ABSTRACT

An actuator for moving a setting member includes a force-generating device; a transmitting member for transmitting a force from the force-generating device to the setting member; a carrier spaced from the transmitting member; and first and second suspension elements spaced from one another parallel to the direction of motion of the transmitting member and being attached to the carrier and the transmitting member for supporting and frictionlessly guiding the transmitting member in motions thereof.

6 Claims, 4 Drawing Sheets

ACTUATOR HAVING A MOVABLE TRANSMITTING ELEMENT WITH FRICTIONLESS GUIDANCE

CROSS REFERENCE TO RELATED APPLICATION

This application claims the priority of German Application No. 297 01 866.3 filed Feb. 4, 1997, which is incorporated herein by reference.

BACKGROUND OF THE INVENTION

In actuators the driving (force-generating) device which has to transmit force and/or motion to a setting member to be served by the actuator, frequently cannot be directly coupled with the setting member; rather, such a coupling has to be effected by a transmission member, such as a push rod which, to ensure its exact longitudinal guidance, is guided in slide guides.

Particularly in actuators in which the transmission member has to be reciprocated with a high frequency and/or with a short stroke and/or with a low force input, the conventional slide guides for the transmission member have significant disadvantages. Apart from energy losses due to friction and wear, in short-stroke actuators in which a timing accuracy is essential, it is of disadvantage that the friction derived from slide guides results in interferences which can be neither qualified nor quantified.

SUMMARY OF THE INVENTION

It is an object of the invention to provide an improved actuator of the above-outlined type from which the discussed disadvantages are eliminated.

This object and others to become apparent as the specification progresses, are accomplished by the invention, according to which, briefly stated, the actuator for moving a setting member includes a force-generating device; a transmitting member for transmitting a force from the force-generating device to the setting member; a carrier spaced from the transmitting member; and first and second suspension elements spaced from one another parallel to the direction of motion of the transmitting member and being attached to the carrier and the transmitting member. The suspension elements which support the transmission member operate in a substantially frictionless manner and ensure a geometrically precise guidance of the transmission member.

According to a preferred embodiment of the invention, the suspension element is a spring element which extends substantially transversely to the longitudinal axis of the transmission member and is, at least at one end, anchored at the carrier and is attached to the transmission member at a location spaced from the anchoring location. Such a spring element which is preferably a leaf spring, ensures a geometrically precise and frictionless guidance of the transmission member. A damping of the spring material is, for example, when steel is used, so small that a practically loss-free transmission of the motion energy from the actuator drive (force-generating device) to the setting member is obtained with the intermediary of the transmission member.

According to a further feature of the invention, the suspension element is a combination spring element which is exposed to bending stresses and to torque stresses in different spring regions. Such an arrangement is advantageous in that the suspension element may be anchored at least at two locations of the carrier and the connection with the transmission member is situated between the two anchor locations. By particularly configuring the suspension element which, upon motion of the transmission member is thus exposed in some zones to bending and in others to torsion, the required stroke amplitudes of the transmission member may be ensured. It is a further advantage of such a dual anchoring of the suspension element that the transmission member may be very accurately guided along its longitudinal axis practically without any transverse excursions.

In case the transmission member, in accordance with a further feature of the invention, is fixedly attached to at least one suspension element, then it is feasible to transversely dimension the transmission member in an arbitrary manner determined by the respective desired function because by virtue of a non-rotatable connection with at least one suspension element an exact guidance in space is ensured.

According to a further preferred embodiment of the invention, the suspension element is formed by a diaphragm-like plate or disk made of a resilient material which at its edge is provided with at least two anchoring inserts and which is further provided with cutouts for forming interconnected, radially extending and circumferentially extending bending regions. Such a configuration has the advantage that even in case of small transverse dimensions of the diaphragm disk relatively large strokes may be performed by means of the suitably configured cutouts.

In a preferred application of the invention, the transmission member is operatively connected with a setting member and with an armature which may be reciprocated against the force of at least one return spring by means of at least one electromagnet and wherein the transmission member is guided by means of at least two suspension elements. Such an arrangement results in an electromagnetic actuator which is capable of a high-frequency reciprocation of the transmitting member and the setting member such as to precisely follow the timing of the current control of the electromagnet.

DESCRIPTION OF THE PREFERRED EMBODIMENTS

Figure 1:
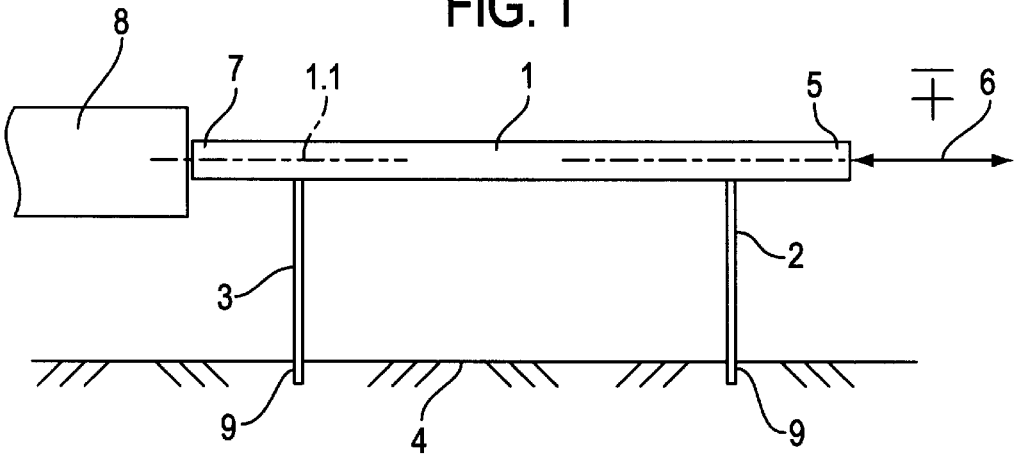
FIG. 1 is a schematic side elevational view of a preferred embodiment of the invention.

FIG. 1 shows a push rod shaped transmission member 1 which forms a component of an otherwise not-illustrated actuator. The transmission member 1 is supported on a carrier 4 by suspension elements 2 and 3. The transmission member 1 may be reciprocated in the direction of the double-headed arrow 6 by a force F applied to an end 5 of the transmission member 1 and generated by a non-illustrated driving assembly (force-generating device) forming another component of the actuator.

The end 7 of the transmission member 1, opposite the end 5 thereof, applies a displacement force to a setting member 8 which, for example, may be a valve stem. In the embodiment illustrated in FIG. 1, both suspension elements 2, 3 are oriented substantially transversely to the longitudinal axis 1.1 of the transmission member 1 and are made of an elastic material such as spring steel and are attached at one end to the transmission element 1. At their other end, the suspension elements are fixedly attached (anchored) to the carrier 4.

In response to the force F the transmission member 1 may move back and forth parallel to its longitudinal axis 1.1 in a frictionless manner. In case of large strokes, the transmission member 1 describes a circularly arcuate path and therefore a displacement transversely to the longitudinal axis 1.1 of the transmission member 1 takes place. In case of small strokes, however, such an arcuate motion is negligibly small. With an appropriate choice of the material or an appropriate dimensioning of the suspension elements 2 and 3 (which act as leaf springs), such a system not only operates in a frictionless manner but is also practically loss-free because in executing the strokes which are in the millimeter range, for example, by using steel, the inertia is negligibly small.

Figure 2:
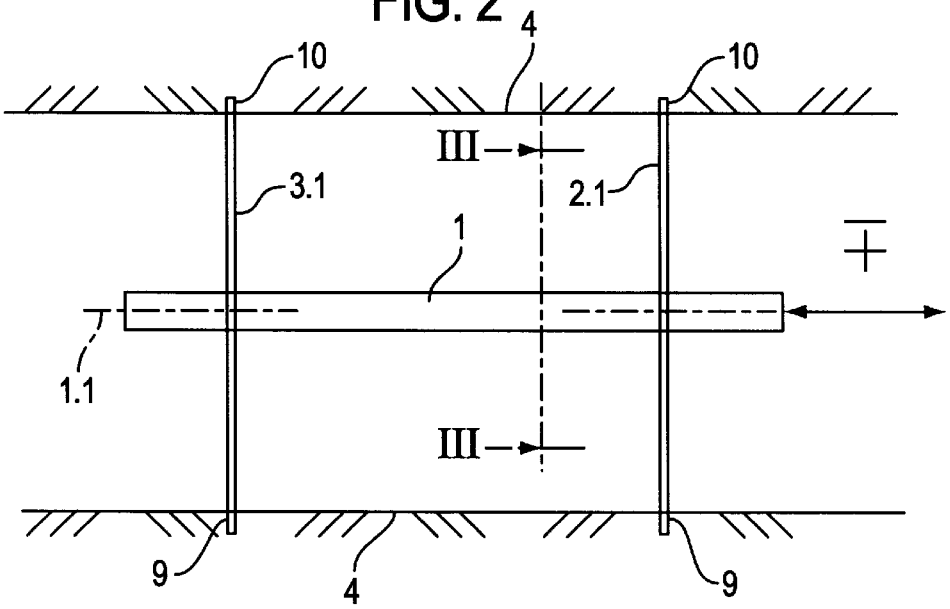
FIG. 2 is a schematic side elevational view of another preferred embodiment of the invention.
Figure 3:
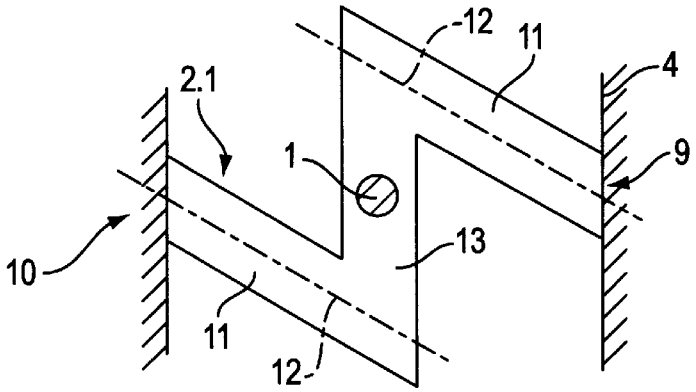
FIG. 3 is a schematic sectional view taken along line III—III of FIG. 2.

FIGS. 2 and 3 show an embodiment of the invention in which suspension elements 2.1 and 3.1 are provided which extend transversely to the longitudinal axis 1.1 of the transmission member 1 towards both sides thereof, and the opposite free ends 9 and 10 of each suspension element 2.1 and 3.1 are fixedly attached to the carrier 4. The suspension elements 2.1 and 3.1 are spring elements, as in the previously described embodiment. While in the embodiment according to FIG. 1, however, the suspension elements 2 and 3 are leaf springs designed for exposure solely to bending forces, for the suspension elements 2.1 and 3.1 of FIG. 2, where a two-point anchoring is present, measures must be taken which ensure the execution of the required stroke path in the longitudinal direction of the transmission member 1. For this purpose each suspension element 2.1 and 2.3 is structured as a combination spring element designed such that in some spring regions it is stressable for bending, while in other spring regions it is stressable for torsion.

The configuration of the combination spring element 2.1 is shown in FIG. 3. Despite a securement of the opposite ends 9 and 10 of the spring element 2.1 to the carrier 4, the spring element 2.1 may bend in a direction perpendicularly to the drawing plane. This is made possible by the fact that when an axial force is applied to the transmission member 1, the partial zones 11 adjoining the anchoring locations 9 and 10 not only bend perpendicularly to the drawing plane but are, at the same time, twisted about their respective longitudinal axes 12. The spring part 13 which interconnects the two spring parts 11 to which the force from the transmission member 1 is directly applied, is thus substantially bent. The longitudinal dimension and the geometric association of the spring parts 11 and 13 allow the provision of a spring element which even in case of bilateral anchoring (as shown in FIGS. 2 and 3) permits the execution of strokes parallel to the axis 1.1. The advantage of this construction resides in that the transmission member 1 is guided exactly parallel to its longitudinal axis 1.1. If the transmission member 1 is non-rotatably attached to at least one of the two suspension elements 2.1 and 3.1 then it is possible to utilize such a guidance for a transmission member 1 which has a shape different from the illustrated simple push rod shape. In this manner a transmission member may be provided which has lateral projections or the like which execute the desired motion in a defined spatial direction and may transmit such a displacement to a setting member.

FIGS. 4, 5, 6, 7, 8 and 9 show different embodiments of suspension elements. They all comprise a diaphragm plate 15 (FIG. 4), 15*a* (FIG. 5), 15*b* (FIG. 6), 15*c* (FIGS. 7 and 8) and 15*d* (FIG. 9), made, for example, of a steel sheet.

Figure 4:
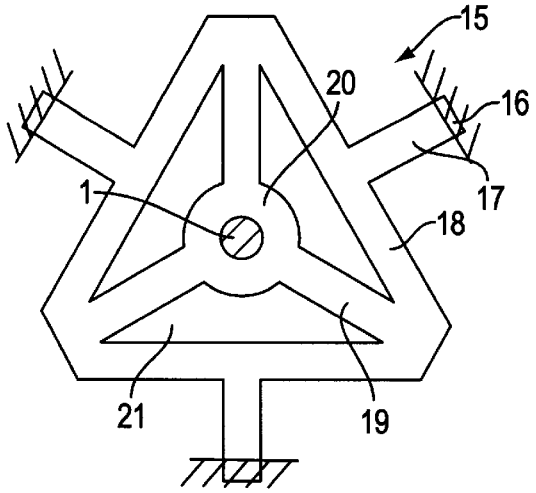
FIGS. 4, 5, 6, 7 and 9 are schematic sectional front elevational views of five further embodiments of the invention.

In the embodiment according to FIG. 4, the plate 15 is symmetrical to its center and has three radially outwardly oriented anchoring projections 16 by means of which the diaphragm plate 15 is fixedly attached to a carrier or a housing 4 of circular cross section. The web-like parts 17 which adjoin the anchoring projections 16 act as bending springs and are, in turn, adjoined by substantially circumferentially extending web-like regions 18 which are exposed in part to bending stress and in part to torsion. The regions 18 which extend in the circumferential direction are adjoined by radially inwardly oriented parts 19 which function as bending springs and which terminate in a holding hub 20 with which the transmission member 1 is at least axially relatively immovably connected. The radially extending parts 17 and 19 are offset relative to one another in the circumferential direction in order to ensure a sufficient bending path for the circumferentially extending parts situated therebetween.

Figure 5:
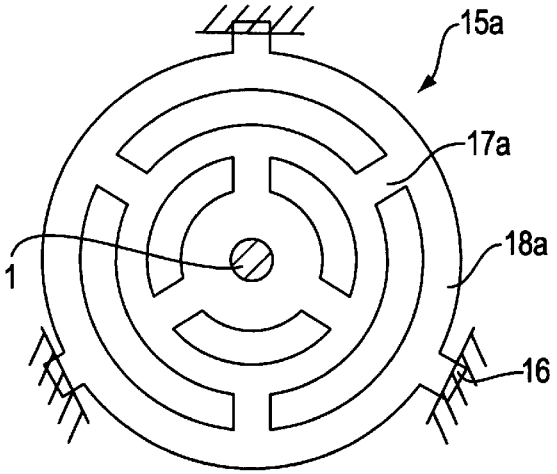

The embodiment illustrated in FIG. 5 is based on the same principle as the embodiment shown in FIG. 4. The difference resides merely in that in the suspension element (diaphragm plate) 15*a* of the FIG. 5 construction the anchoring projections 16 are, as viewed radially inwardly, first adjoined by a circumferentially extending region 18*a* which, in turn, is adjoined by radially oriented parts 17*a* which are circumferentially offset relative to parts 16. This configuration may be repeated radially inwardly toward the longitudinal axis of the transmission member 1.

Figure 6:
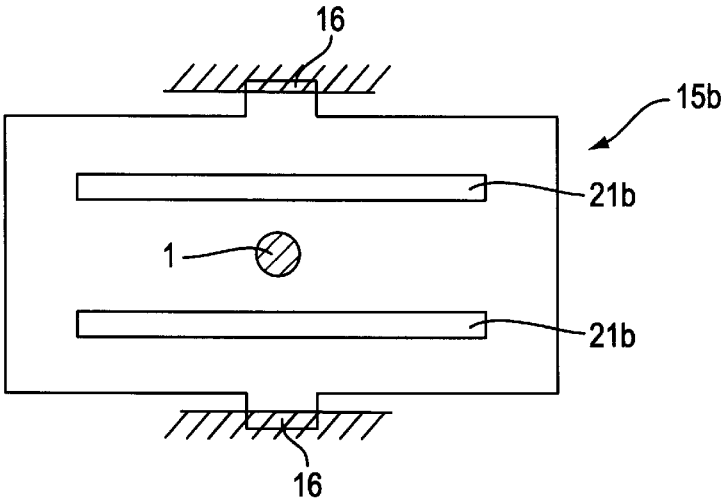

The embodiment according to FIG. 6 shows a diaphragm plate 15*b* which has a rectangular outline and further, along the opposite longitudinal sides oppositely oriented anchoring projections 16 are provided. Two parallel slots 21*b* provide for the desired axial mobility of the transmission member 1, perpendicularly to the drawing plane of FIG. 6. The ratio between the short and long sides of the rectangular contour and the width of the slots 21*b* essentially determine the bending behavior of the diaphragm plate perpendicularly to its plane and thus determine the stroke of a transmission member 1 connected thereto.

Figure 7:
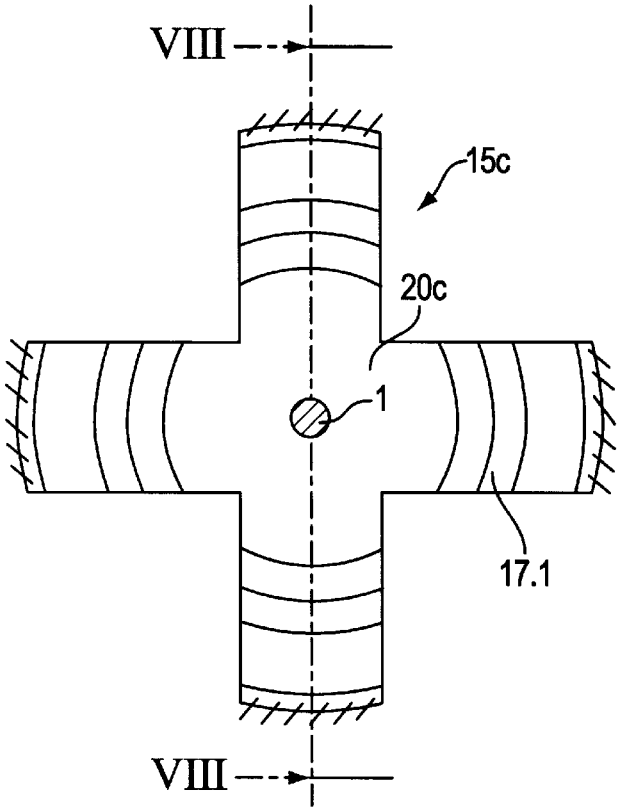
Figure 8:
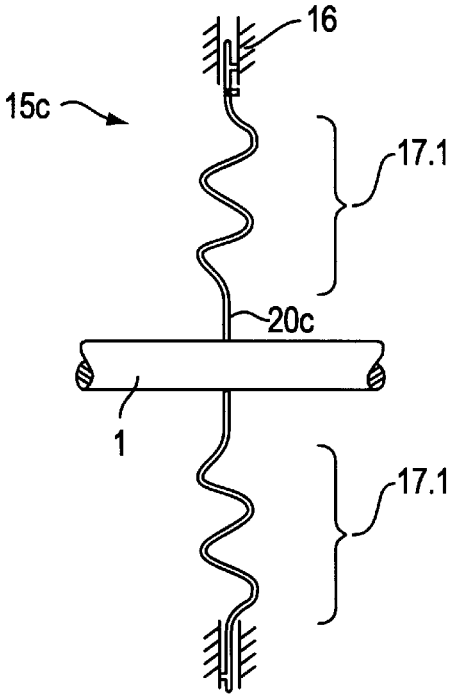
FIG. 8 is a schematic sectional view taken along line VIII—VIII of FIG. 7.

FIGS. 7 and 8 show a suspension element 15*c* whose structure is based on a different concept. In such a suspension element which is a diaphragm plate made of an elastic material, at least two but preferably at least three radially oriented parts 17.1 extend from the central hub 20*c* with which the transmission member 1 is connected. As seen in FIG. 8, the parts 17.1 are provided with corrugations oriented perpendicularly to the plane of the diaphragm plate. Such a structure ensures that despite the given anchoring of the free ends of the parts 17.1, a "deformation reserve" is provided for a reciprocating motion of the transmission member 1 in the direction of its longitudinal axis. The desired magnitude of the stroke of the transmission member 1 determines the magnitude of the "deformation reserve", that is, the number and the crest heights of the radially consecutive corrugations.

Figure 9:
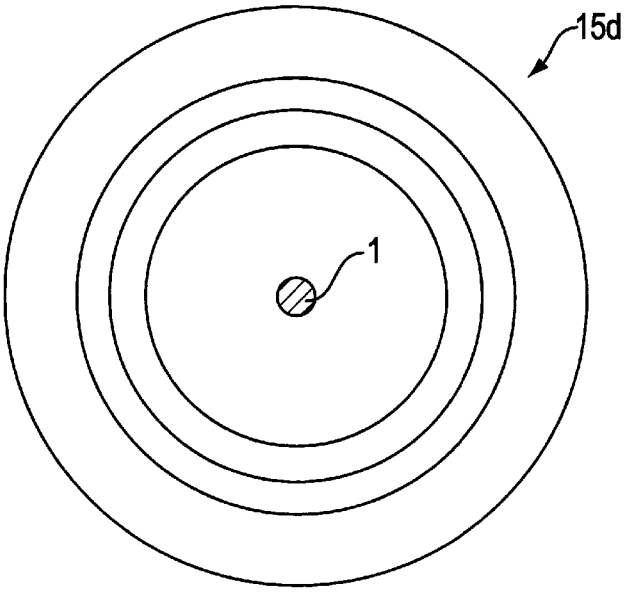

FIG. 9 shows a structure which is a variant of the FIG. 7 construction. The suspension element 15*d* of FIG. 9 is a diaphragm disk having a full circular surface which is concentrically corrugated so that in a radial section it has a configuration which is identical to that shown in FIG. 8. In the FIG. 9 structure too, the desired stroke determines the magnitude of the "deformation reserve" that is, the number of the radially consecutive corrugations. In the embodiment of FIG. 7 as well as in that of FIG. 9, the diaphragm plate or disk is made of an elastic material and thus functions as a spring element.

It appears from the foregoing description of the various embodiments of the suspension element that the constructional principle admits to relatively large-amplitude strokes for the transmission member of the actuator. By appropriate dimensioning of the suspension elements excursions of the transmission member may take place from a mid position defined by the plane of the suspension members in either direction to an extent of several (for example, 5) mm.

It is not necessary that the diaphragm plate lie in a planar middle plane in the unstressed state and that, accordingly, the strokes be executed from a position of rest when such middle plane is planar. It is thus also feasible to make the diaphragm plate arcuate (to thus have a curved middle plane in the unstressed state) to fix the starting position so that the transmission member may, from an end position determined in this manner, move to an end position determined by an oppositely directed curvature.

In case the transmission member 1 guided by the described suspension elements is to be operatively coupled with at least one resetting spring for performing the desired function, the use of suspension elements made of a spring-elastic material offers the possibility to design the spring characteristic of the suspension elements such that they simultaneously perform the function of return (resetting) springs. In this arrangement it is possible to affect not only the spring rate by a suitable configuration or shaping of the width and/or the thickness of the regions exposed to deformation, but also to affect the spring characteristics.

Figure 10:
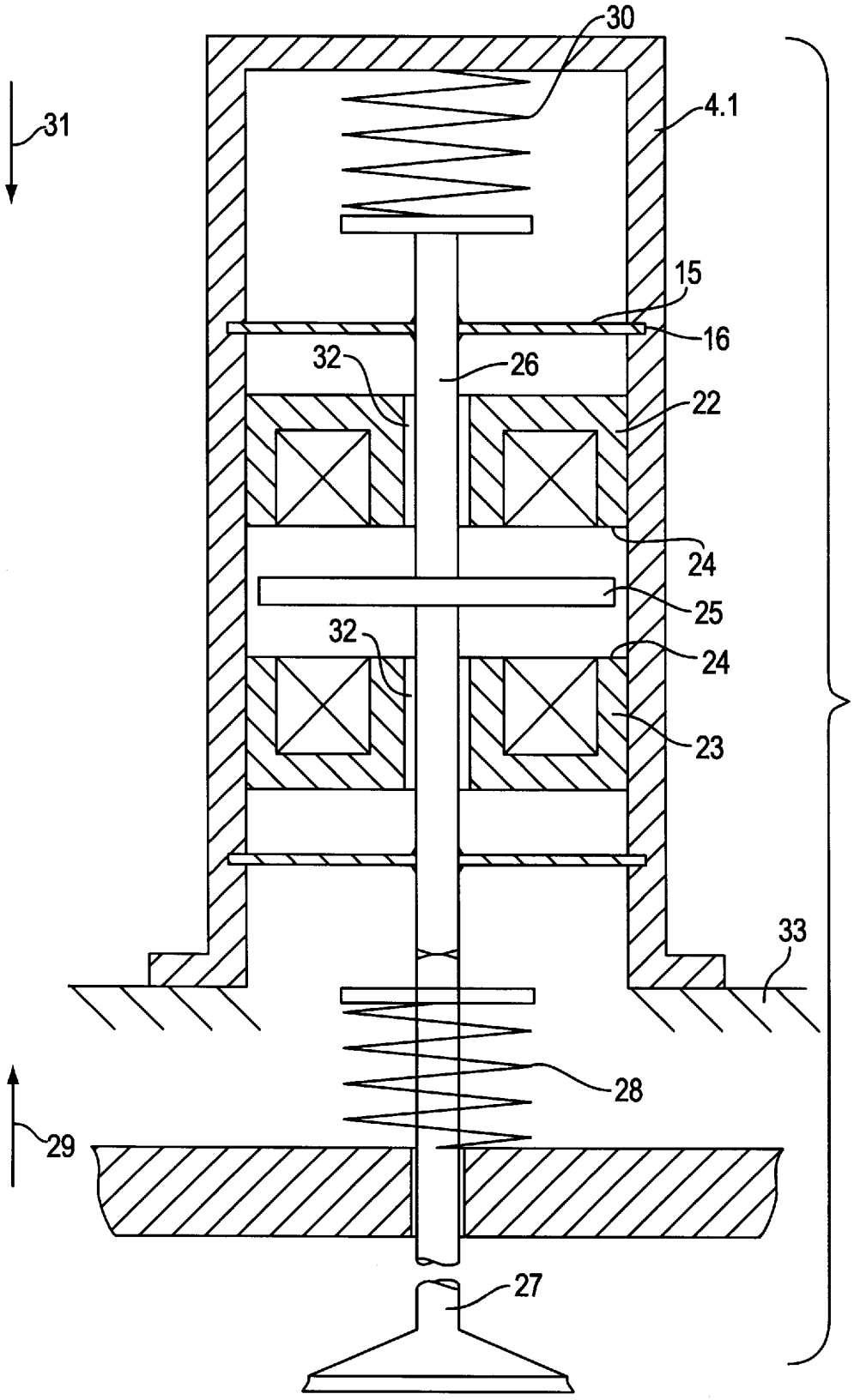
FIG. 10 is a schematic axial sectional view of an electromagnetic actuator incorporating the invention.

FIG. 10 illustrates an embodiment for a practical use of a guiding arrangement based on the principle shown in FIG. 2. FIG. 10 shows an electromagnetic actuator which has two spaced electromagnets 22, 23 whose pole faces 24 are mutually oriented towards one another. The electromagnets 22 and 23 are coupled to a non-illustrated current supply so that by a suitable control device the two electromagnets may be alternatingly energized. It is to be understood that the invention may also find application in an electromagnetic actuator which has only a single electromagnet.

An armature 25 is movably disposed between the two electromagnets 22 and 23 and is fixedly connected with a transmitting member 26 constituted by a push rod. The transmitting member 26 cooperates with a setting member constituted by a cylinder valve 27 of a piston-type internal-combustion engine. The cylinder valve 27 is urged into the closed position in the direction of the arrow 29 by a first return spring (closing spring) 28. At the other end of the transmitting member 26 a second return spring (opening spring) 30 is provided which urges the transmitting member 26 in the direction of the arrow 31 into the open position of the cylinder valve 27. The two return springs 28 and 30 are designed such that when the electromagnets 22 and 23 are in a de-energized state, the armature 25 is held by the return springs 28, 30 in the illustrated mid position.

The electromagnets 22 and 23 have a circular or rectangular cross section and are each provided with a central bore 32 through which the push rod 26 (transmitting member) passes. The diameter of the bores 32 in the electromagnets 22 and 23 is so dimensioned that the push rod 26 remains out of contact with the walls of the bores 32.

The guidance of the push rod 26 in its axial direction is effected in this embodiment by two diaphragm plates 15 which act as suspension elements and which are thus designed according to FIG. 4. These suspension elements, however, may have any other shape and thus may be designed, for example, as diaphragm plates 15*a*, 15*b*, 15*c* or 15*d* illustrated in FIGS. 5–9, respectively. The diaphragm plates 15 are, at their anchoring projections 16, clamped into the housing 4.1 which acts as a carrier therefor and which also positions the electromagnets 22, 23. The housing 4.1 is connected with the cylinder head 33 of the internal combustion engine by conventional, non-illustrated securing means.

In operation, the electromagnets 22 and 23 are energized in an alternating manner so that the armature 25 is moved back and forth between the "valve closed" position of the valve 27 defined by the pole face 24 of the electromagnet 22 and the "valve open" position of the valve 27 defined by the pole face 24 of the electromagnet 23. By a suitable control of the current intensity and current course, various different motion behaviors may be obtained for the cylinder valve 27. By guiding the push rod 26 by means of the suspension elements 15, it is ensured that no friction-caused energy loss occurs in the electromagnetic actuator.

In the electromagnetic actuator shown in FIG. 10 the suspension elements 15 are so designed that their spring rate is negligibly small compared to the those of the return springs 28 and 30. The actuator principle illustrated in FIG. 10 shows that by a suitable design of the spring characteristic and/or a suitable selection of the number of suspension elements formed by the diaphragm plates 15, the latter may assume the function of at least one of the return springs 28 and 30. By virtue of a plurality of elastic suspension elements forming stacks and arranged parallel to one another, even with thin diaphragm plates a high spring characteristic (hard spring) and thus a large resetting force may be obtained. If, for example, the upper return spring 30 is to be replaced by the suspension elements 15, then in the de-energized state of the electromagnets 22 and 23 under the effect of the return spring 28 the suspension elements 15 which simultaneously function as spring elements are flexed upwardly corresponding to the bias of the resetting spring 28. The "deformation reserve" contained in the suspension elements 15 and determined by the shape thereof has to be of such a magnitude that a further motion of the armature 25 to the terminal zone at the pole face 24 of the upper electromagnet 22 is ensured.

It will be understood that the above description of the present invention is susceptible to various modifications, changes and adaptations, and the same are intended to be comprehended within the meaning and range of equivalents of the appended claims.

What is claimed is:

1. An electromagnetic actuator in combination with a cylinder valve of an internal-combustion engine, comprising (a) a carrier;

(b) first and second electromagnets each having respective first and second pole faces oriented towards and spaced from one another;

(c) a plate-shaped armature disposed between said first and second pole faces and being movable therebetween by electromagnetic forces generated in an energized state of at least one of said first and second electromagnets;

(d) a rod-shaped transmitting member having a longitudinal axis; said transmitting member carrying said armature and being axially movable; said transmitting member being coupled to said cylinder valve for effecting displacements of said cylinder valve;

(e) at least one resetting spring operatively connected to said transmitting member for maintaining said armature in a mid position between said first and second pole faces in a de-energized state of said first and second electromagnets; said resetting spring having a first spring rate; and (f) first and second suspension elements spaced from one another and being attached to said carrier and said transmitting member for supporting and guiding said transmitting member by suspension, whereby said transmitting member is movable without sliding friction; said suspension elements being oriented transversely to said longitudinal axis and having a second spring rate being negligible relative to said first spring rate, whereby said resetting force is generated substantially by said resetting spring.

2. The actuator as defined in claim 1, wherein each said suspension element comprises a resilient element oriented substantially transversely to said longitudinal axis; said resilient element having a first end anchored to said carrier and a second end attached to said transmitting member.

3. The actuator as defined in claim 2, wherein said resilient element has a first portion configured to be stressed for bending and a second portion configured to be stressed for torsion.

4. The actuator as defined in claim 1, wherein at least one of said suspension elements comprises a resilient diaphragm plate secured to said transmitting member and having (a) an outer periphery;

(b) at least two anchoring projections formed on said diaphragm plate and extending from said outer periphery and being anchored to said carrier; and (c) cutouts provided in said diaphragm plate; said cutouts defining a plurality of first, mutually spaced bending regions extending radially to said longitudinal axis and second, mutually spaced bending regions extending circumferentially about said longitudinal axis.

5. The actuator as defined in claim 1, wherein said transmitting member is relatively non-rotatably secured to at least one of said suspension elements.

6. The actuator as defined in claim 1, wherein said carrier includes a housing; said housing accommodating said first and second suspension elements and said first and second electromagnets; said first and second suspension elements being anchored to said housing.

* * * * *